US006067919A

United States Patent [19]

Shoji

[11] Patent Number: 6,067,919

[45] Date of Patent: May 30, 2000

[54] NEEDLE THREADING DEVICE USED IN SEWING MACHINE

[75] Inventor: Yoshihisa Shoji, Nagoya, Japan

[73] Assignee: Brother Kogyo Kabushiki Kaisha, Nagoya, Japan

[21] Appl. No.: 09/317,177

[22] Filed: May 24, 1999

[30] Foreign Application Priority Data

May 25, 1998 [JP] Japan ..... 10-143334

[51] Int. Cl.[7] ..... D05B 87/02

[52] U.S. Cl. ..... 112/225

[58] Field of Search ..... 112/224, 225, 112/302; 223/99

[56] References Cited

U.S. PATENT DOCUMENTS

| | | | |
|---|---|---|---|
| 4,649,843 | 3/1987 | Muroi et al. | 112/225 X |
| 5,003,900 | 4/1991 | Ogawa | 112/225 X |
| 5,195,452 | 3/1993 | Kamiya | 112/225 |

FOREIGN PATENT DOCUMENTS

| | | | |
|---|---|---|---|
| 456606 | 11/1991 | European Pat. Off. | 112/225 |
| 3-133485 | 6/1991 | Japan . | |
| 7-24715 | 3/1995 | Japan . | |
| 1030300 | 5/1966 | United Kingdom | 112/225 |

*Primary Examiner*—Ismael Izaguirre
*Attorney, Agent, or Firm*—Oliff & Berridge, PLC

[57] ABSTRACT

The hook mechanism 30 and the first thread guide member 24 are attached to the lower end of the needle threading shaft 21 so as to be integrally with each other. The second thread guide member 26 is rotatably supported by the needle threading shaft 21. When the needle threading shaft 21 rotates in the clockwise direction C, the second thread guide member 26 is pivoted by the link mechanism 50 in the direction toward the hook mechanism 30 and away from the first thread guide member 24. As a result, the needle threading hook 32 reaches the sewing needle 11 and penetrates through the sewing needle eye 11*a* of the sewing needle 11. Also, an amount of the upper thread 23 required for threading the sewing needle 11 is automatically fed from the free end portion 23*a* of the upper thread 23 in a simple manner.

16 Claims, 13 Drawing Sheets

NEEDLE THREADING DEVICE USED IN SEWING MACHINE

BACKGROUND OF THE INVENTION

1. Field of the Invention

The present invention relates to a needle threading device used in a sewing machine, for automatically passing an upper thread through an eye of a sewing needle when a lever provided to the sewing machine is pressed down.

2. Description of the Related Art

A sewing machine, such as a household electrically controlled sewing machine and an industrial sewing machine, includes a motor for driving a needle bar to move in the vertical direction via a principle shaft. The needle bar detachably supports a sewing needle at its lower end. Stitches are formed by cooperative operation between the vertically moving sewing needle and a loop taker that is driven in synchronization with the vertical movement of the sewing needle.

A variety of different types of needle threading devices for automatically threading the sewing needle have been provided for use in the sewing machine.

For example, Japanese Patent-Application Publication (Kokai) No. HEI-3-133485 discloses one type of needle threading unit having a needle threading hook and a thread catching mechanism. The thread catching mechanism includes an upper plate and a lower plate for pressingly holding the upper thread therebetween. The lower plate is formed with a groove on its upper surface. With this configuration, the hook is pivoted at a position level with the needle eye of the sewing needle, and passes through the needle eye. Because the upper thread is provided in front of the needle eye at this time, the hook catches on the upper thread. When the hook pulls out the upper thread through the needle eye, the upper thread gets caught in the groove of the lower plate. As a result, the pressing force on the upper thread between the upper and lower plates is released. Therefore, the upper thread is freely supplied from the free end portion of the upper thread by the amount required for the hook to draw out the upper thread through the needle. In this way, the sewing needle can be threaded.

However, when the user wishes to use an upper thread with a thickness greater than the width of the groove, the upper thread will not fit into the groove. As a result, pressing force on the upper thread cannot be released, so the sewing needle cannot be threaded. In order to overcome this problem, it is conceivable to form the groove with a greater width. However, in this case, when a thin upper thread is used, the upper thread can undesirably enter the groove easily when the hook moves to the position level with the needle eye. As a result, the upper thread cannot be provided in front of the needle eye when the hook passes through the needle eye. In this case also, the sewing needle cannot be threaded.

Japanese Patent Publication (Kokoku) No. HEI-7-24715 discloses a sewing machine capable of automatically threading a sewing needle by using a linking mechanism that links movement of a hook and a tension disk. Specifically, when a slider is lowered, a hook is pivoted at a position level with the needle eye of the sewing needle, and passes through the needle eye so as to hook on the upper thread. Simultaneously, a member of the linking mechanism pivots in linking association with lowering movement of the slider. The pivoting movement of the member releases pressing force of the tension disk on the upper thread. As a result, the upper thread is supplied from a thread spool via the tension disk by the amount required for the hook to pull out of the needle eye.

However, this configuration requires the linking mechanism including a plurality of members, and increases the number of required components. Also, because pressure of the tension plate is released by the member, the position of the thread tension mechanism is restricted to a location accessible by the member.

SUMMARY OF THE INVENTION

It is an objective of the present invention to overcome the above described problems and also to provide a simplified needle threading device capable of automatically feeding out an upper thread in an amount required for threading a sewing needle and requiring a simple operation for catching the upper thread.

In order to achieve the above and other objectives, there is provided a needle threading device used in a sewing machine including a needle bar extending in a vertical direction and supporting a sewing needle formed with an eye. The needle threading device includes a hook mechanism, a first thread guide, and a second thread guide. The hook mechanism is pivotable from an initial position to a pivoted position by a predetermined angle. The hook mechanism includes a hook. When the hook mechanism pivots to the pivoted position, the hook penetrates through the eye of the sewing needle. The first thread guide is provided at a position separated from the hook mechanism by a predetermined distance. The second thread guide is provided at a position close to the first thread guide. When the hook mechanism pivots to the pivoted position, the second thread guide pivots relative to the first thread guide so as to locate at a substantially opposite side of the sewing needle from the first thread guide.

There is also provided a needle threading device used in a sewing machine including a needle bar stand and a needle bar supported by the needle bar stand. The needle bar extends in a vertical direction and supports a sewing needle formed with an eye. The needle threading device includes a threading shaft, a hook mechanism, a pivot mechanism, a first thread guide, a second thread guide, and a link mechanism. The threading shaft extends in the vertical direction, and is supported by the needle bar stand at a position close to the needle bar so as to be rotatable and movable in the vertical direction. The hook mechanism is attached to an lower end of the threading shaft, and has a hook. The pivot mechanism lowers the threading shaft from a predetermined upper position to a predetermined lower position and rotates the threading shaft in a rotational direction by a predetermined angle at the predetermined lower position. When the pivot mechanism rotates the threading shaft at the predetermined lower position, the hook mechanism is pivoted in the rotational direction together with the threading shaft, and the hook penetrates through the eye of the sewing needle. The first thread guide is fixed at the lower end of the threading shaft at a position separated from the hook mechanism by a predetermined distance. The second thread guide that is pivotably supported by the lower end of the threading shaft. When the threading shaft is at the predetermined upper position, the second thread guide is at a position close to the first thread guide. The link mechanism links the first thread guide and the second thread guide such that when the pivot mechanism rotates the threading shaft in the rotational direction, the second thread guide pivots relative to the first thread guide so as to locate at a substantially opposite side of the sewing needle from the first thread guide.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENT

A needle thread device according to a preferred embodiment of the present invention will be described while referring to the accompanying drawings. In the following description, the expressions "front", "rear", "left", "right", "vertical", "horizontal", "up", "down" "above", and "below" are used throughout the description to define the various parts when the needle thread device is disposed in an orientation in which it is intended to be used.

The present invention is applied to a needle threading device of an electric control sewing machine provided with an embroidery frame drive mechanism so as to be capable of sewing a variety of embroidery patterns.

Figure 1:
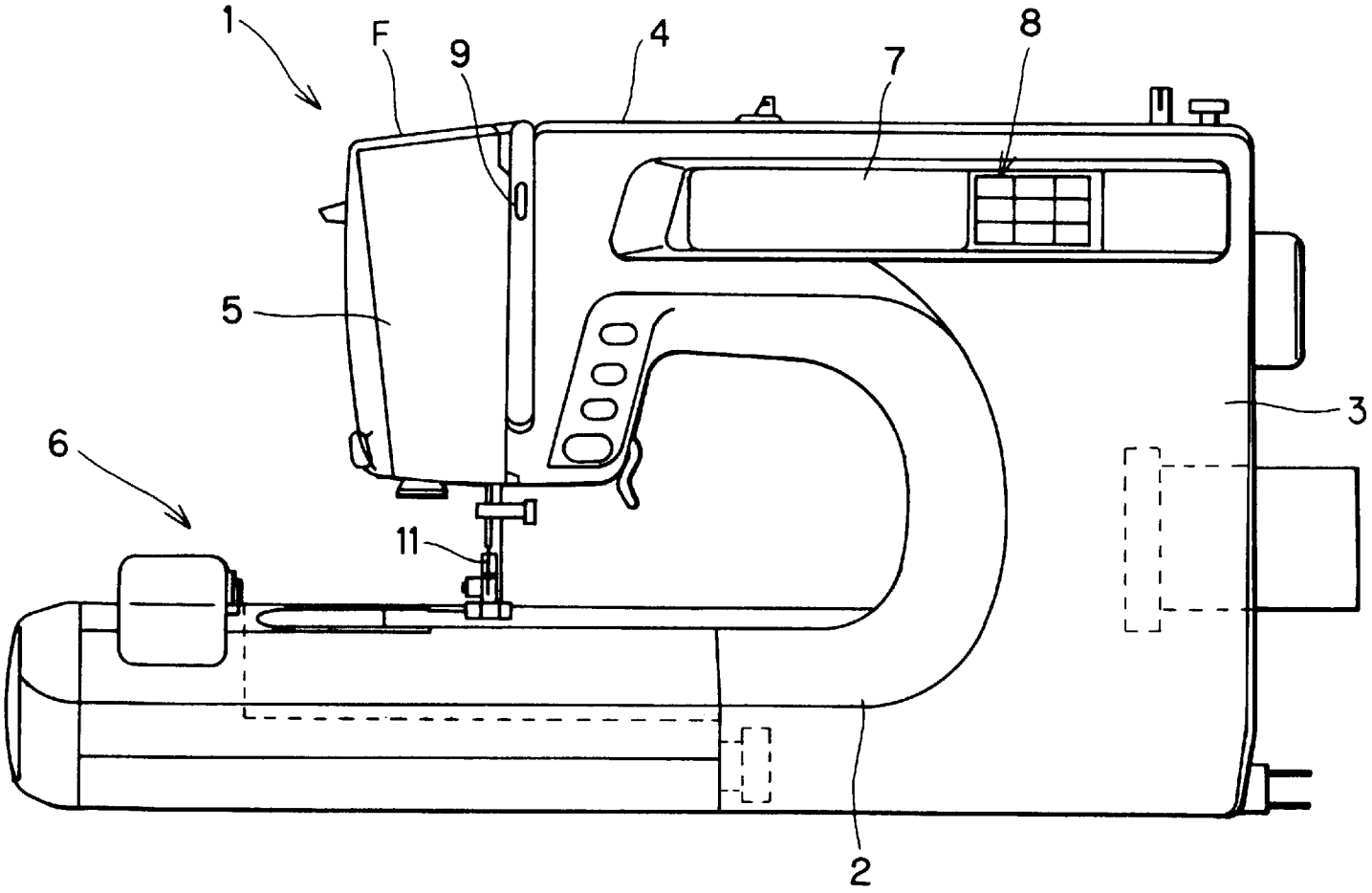
FIG. 1 is a plan view showing a sewing machine including a needle threading device according to an embodiment of the present invention.

As shown in FIG. 1, an electric control sewing machine 1 includes a sewing machine bed portion 2, a column portion 3, an arm portion 4, and an embroidery drive mechanism 6. The column portion 3 extends upward from the right end of the bed portion 2. The arm portion 4 extends leftward from the upper end of the column portion 3 so as to be in confrontation with the bed portion 2.

Also, although not shown in the drawings, the bed portion 2 houses a feed dog vertical movement mechanism for vertically moving a feed dog, a feed dog front and rear drive mechanism for driving front and rear movement of the feed dog, and a loop taker, such as a vertical axis oscillating shuttle. The look taker houses a lower thread bobbin and operates in association with a sewing needle 11 to be described later.

Although not shown in the drawings, a free bed portion referred to as a free arm is provided to the left end of the bed portion 2. The embroidery drive mechanism 6 is detachably mounted on the free bed portion. The embroidery drive mechanism 6 includes an internal Y direction drive mechanism and an X-direction drive mechanism. The Y-direction drive mechanism drives the movement of the embroidery frame in a Y-direction, that is, in front and rear directions. The X-direction drive mechanism drives the movement of the embroidery frame in an X-direction, that is, in left and right directions.

A liquid crystal display 7 and an operational panel 8 are disposed adjacent to each other on the front surface of the arm portion 4. A head portion 5 and a thread takeup lever are provided to the arm portion 4.

Although not shown in the drawings, a needle bar swing mechanism and a thread takeup lever vertical drive mechanism are provided in the arm portion 4. The needle bar swing mechanism is for swinging a needle bar 10 in a direction that intersects the direction in which the work piece cloth is fed. The thread takeup lever vertical drive mechanism is for driving vertical movement of the thread takeup lever 9 in synchronization with vertical movement of the needle bar 10.

Figure 2:
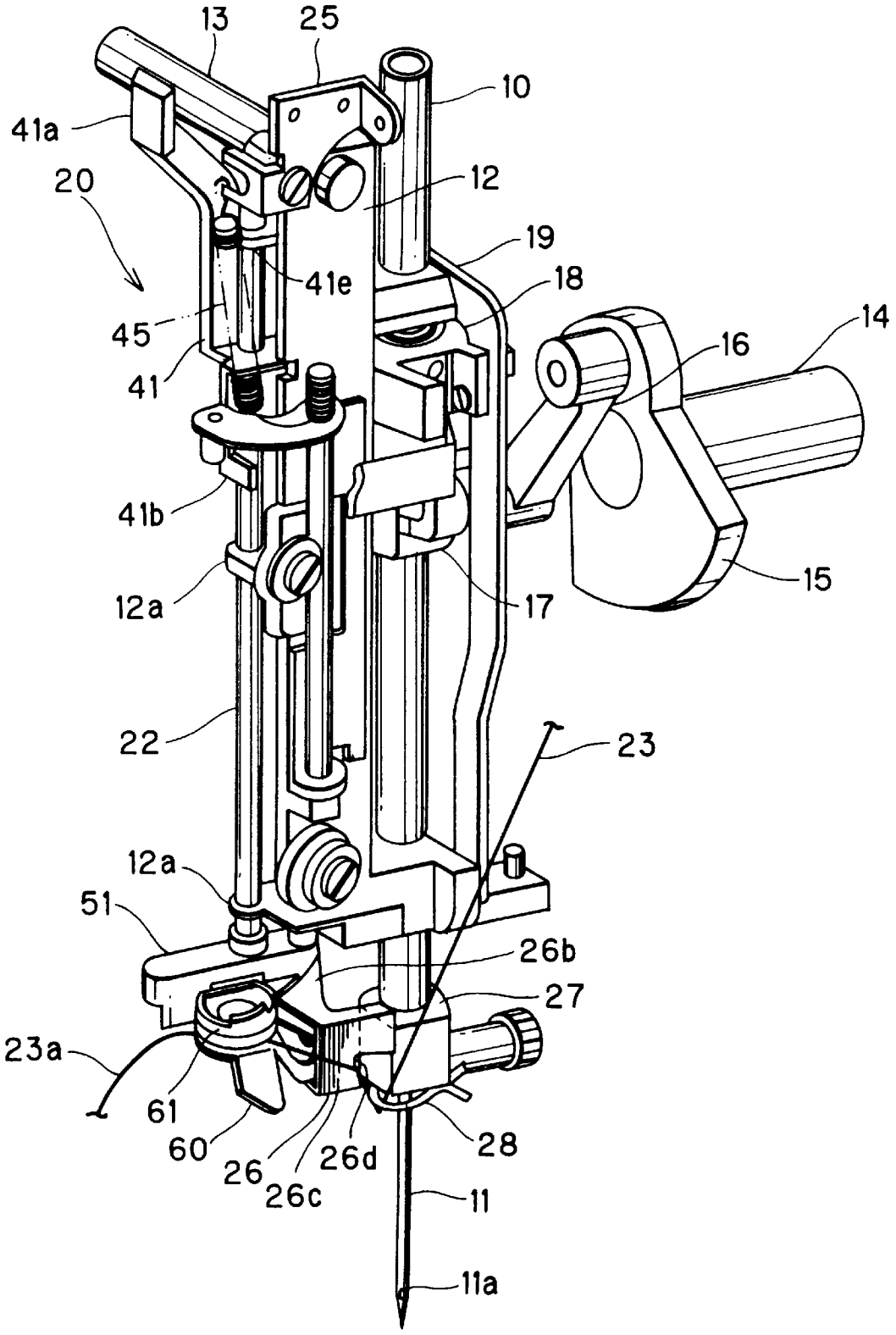
FIG. 2 is a perspective view of the needle threading device.
Figure 3:
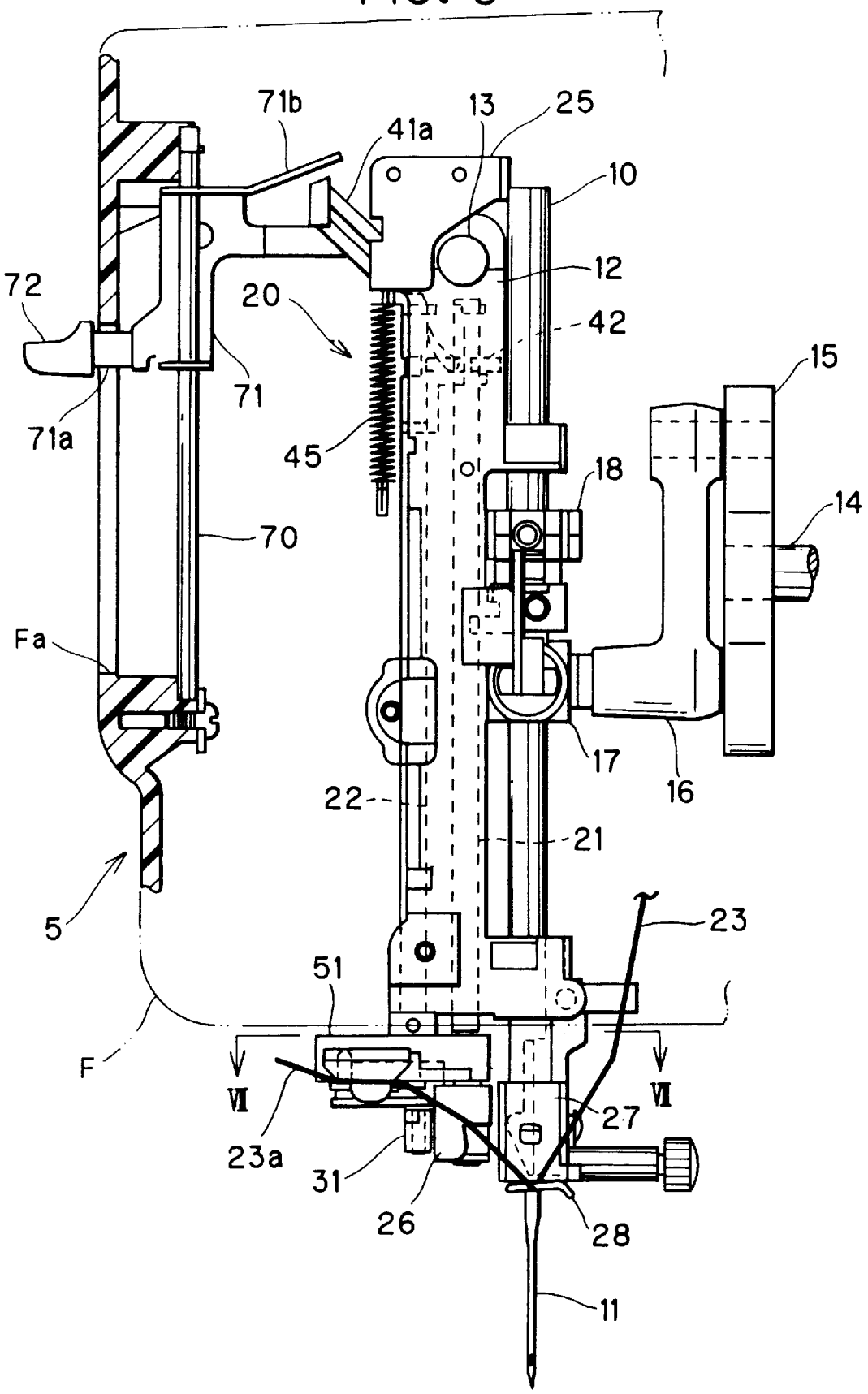
FIG. 3 is a front view showing the needle threading device attached to a head portion of the sewing machine.

As shown in FIGS. 2 and 3, the head portion 5 is provided with a frame F, the needle bar 10, a sewing needle 11, a needle bar stand 12, a shaft 13, a principle shaft 14, a needle bar crank 15, a crank rod 16, a needle bar connecting bracket 17, a guide member 18, and a guide plate 19. The shaft 13 is fixed to the frame F. The needle bar stand 12 extends vertically, and is swingably supported on the shaft 13 at its upper end. The needle bar stand 12 vertically movably supports the needle bar 10. The guide member 18 is fixed to the needle bar 10. The guide plate 19 is attached to the needle bar stand 12 with a vertically aligned posture.

The needle bar crank 15 is fixed to the end of the principle shaft 14. The crank rod 16 is pivotably mounted on the needle bar crank 15. The needle bar connecting bracket 17 is connected to the crank rod 16. The guide member 18 and the guide plate 19 are slidably engaged with each other, so that the needle bar 10 is prevented from rotating. When the principle shaft 14 is driven to rotate by a sewing machine motor (not shown), the needle bar 10 is driven to move vertically via the needle bar crank 15, the crank rod 16, and the needle bar connecting bracket 17.

A needle mount 27 is attached to the lower end of the needle bar 10. A thread guide 28 is attached to the lower side of the needle mount 27. The sewing needle 11 has a sewing needle eye 11*a* and is detachably mounted on the needle mount 27.

The head portion 5 is also provided with a needle threading unit 20 for threading an upper thread 23 through the sewing needle eye 11*a* of the sewing needle 11 mounted on the lower end of the needle bar 10.

As shown in FIGS. 2 to 5, the needle threading unit 20 includes a needle threading shaft 21, an operation shaft 22, and a second thread guide member 26. The needle threading shaft 21 and the operation shaft 22 are both disposed behind the needle bar stand 12 and extend in the vertical direction. A plurality of support portions 12*a* are formed in the needle bar stand 12. The support portions 12*a* rotatably and vertically movably support the needle threading shaft 21 at a position adjacent to the needle bar 10. The support portions 12*a* also vertically movably support the operation shaft 22 in a position adjacent to the needle threading shaft 21.

Figure 4:
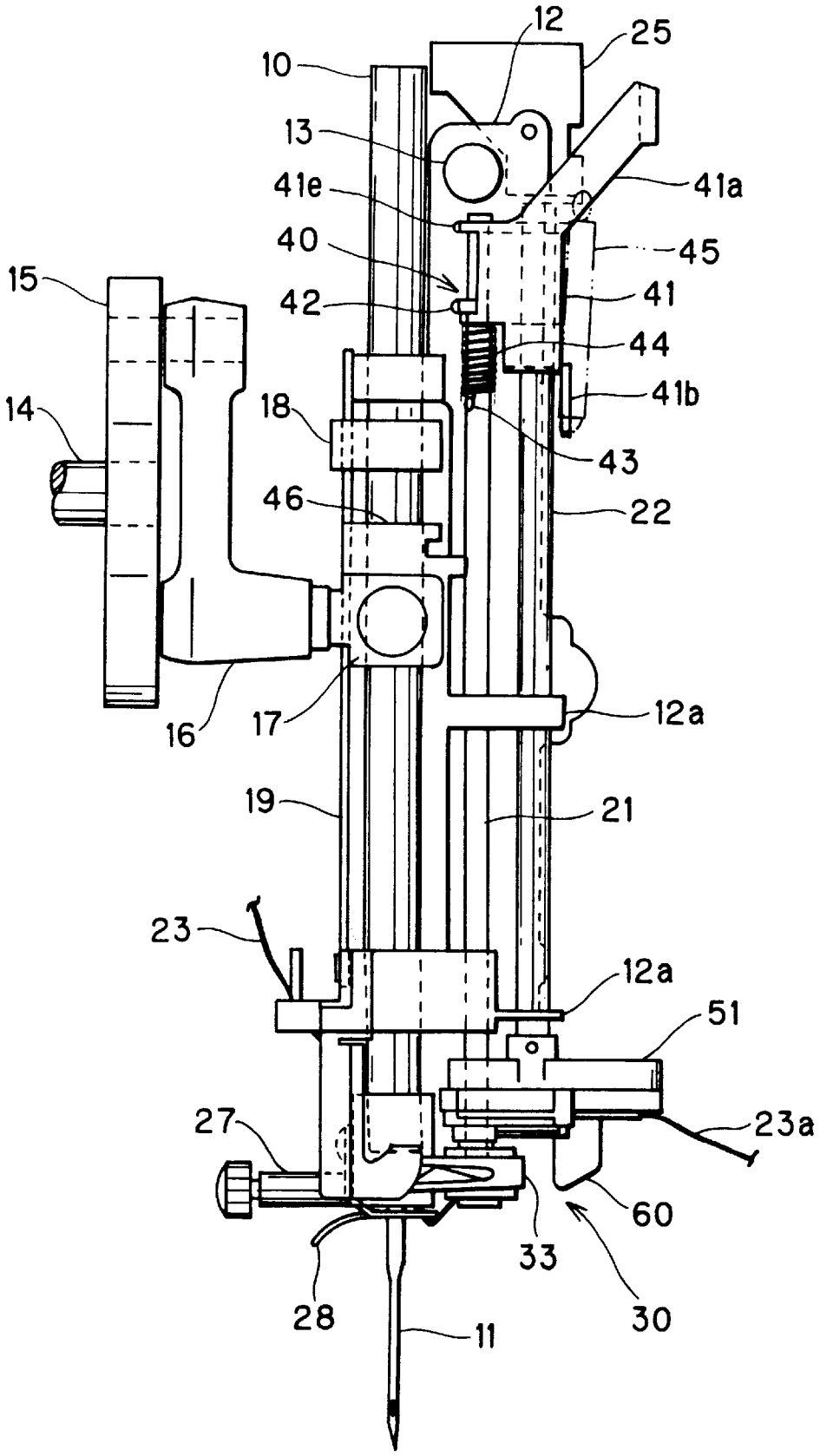
FIG. 4 is a rear view showing the needle threading device.
Figure 5:
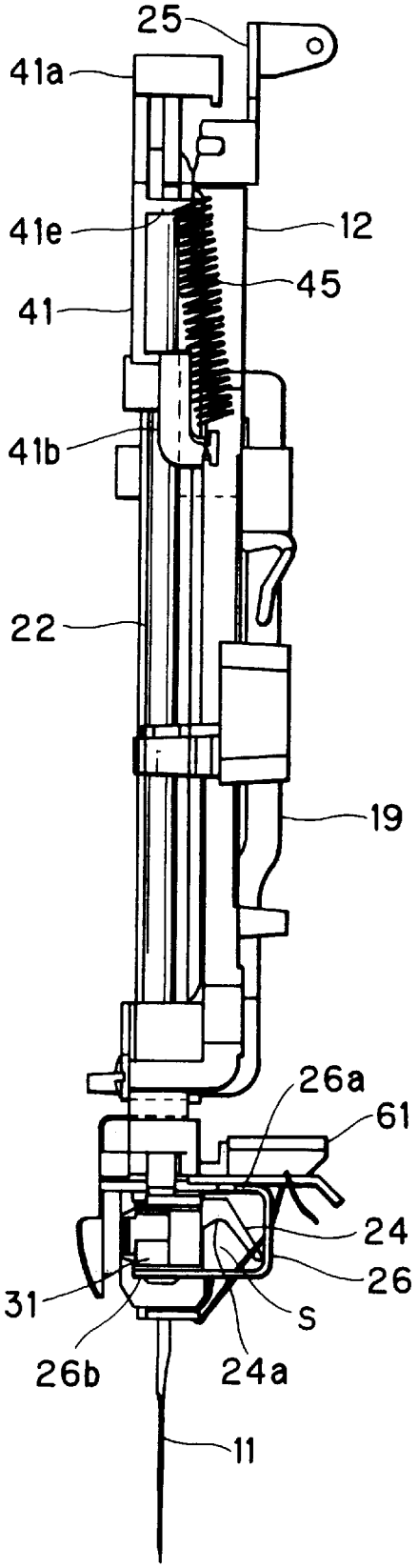
FIG. 5 is a left side view showing the needle threading device.

As shown in FIG. 5, the second thread guide member 26 has a substantial C shape as viewed from the side, and defines an inner space S. More specifically, as shown in FIGS. 2 to 5, the second thread guide member 26 includes a vertically oriented connection wall 26*c* and a pair of horizontally extending support portions 26*a*, 26*b*, which are connected together by the connection wall 26*c*. The support portions 26*a*, 26*b* are both rotatably supported on the needle threading shaft 21, so that the second thread guide member 26 is pivotally supported on the needle threading shaft 21. The connection wall 26*c* defines a thread guide portion 26*d* for engaging with and guiding the upper thread 23.

The needle threading unit 20 further includes a first thread guide member 24, a hook mechanism 30, a pivot mechanism 40, and a link mechanism 50.

Figure 7:
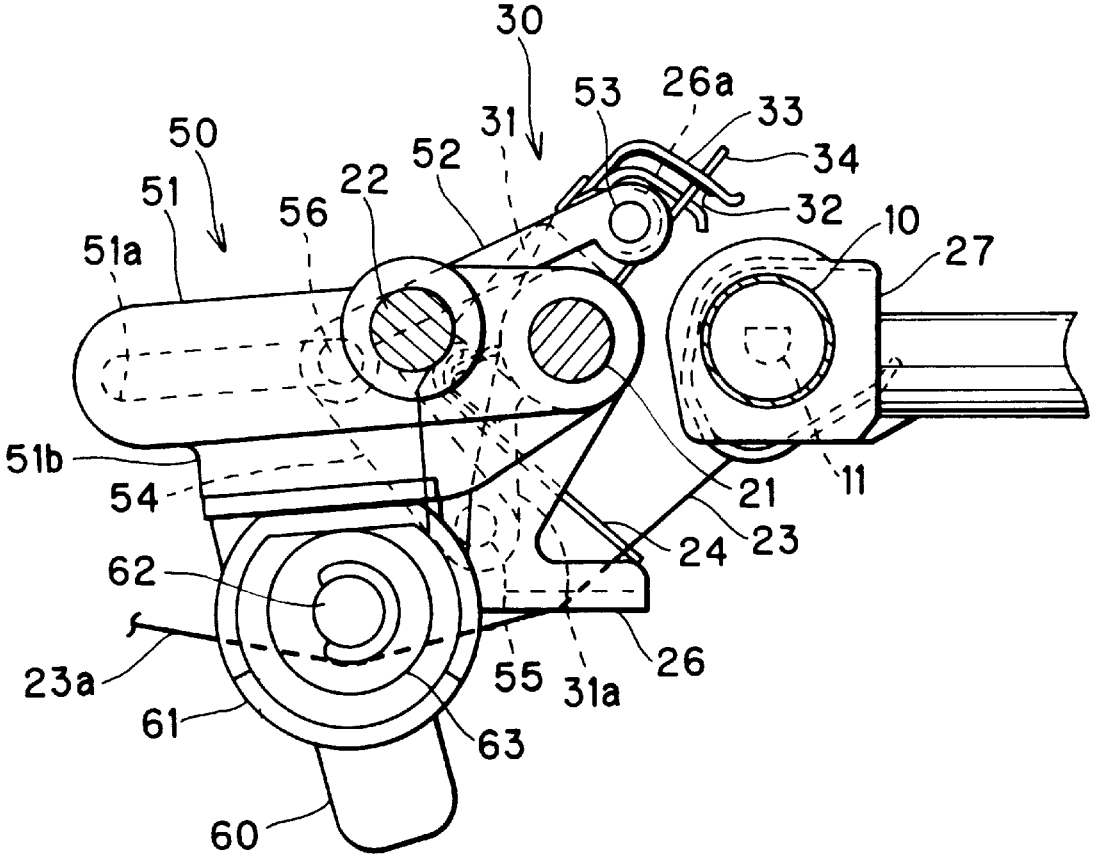
FIG. 7 is a cross-sectional view taken along a line VII—VII of FIG. 3.
Figure 8:
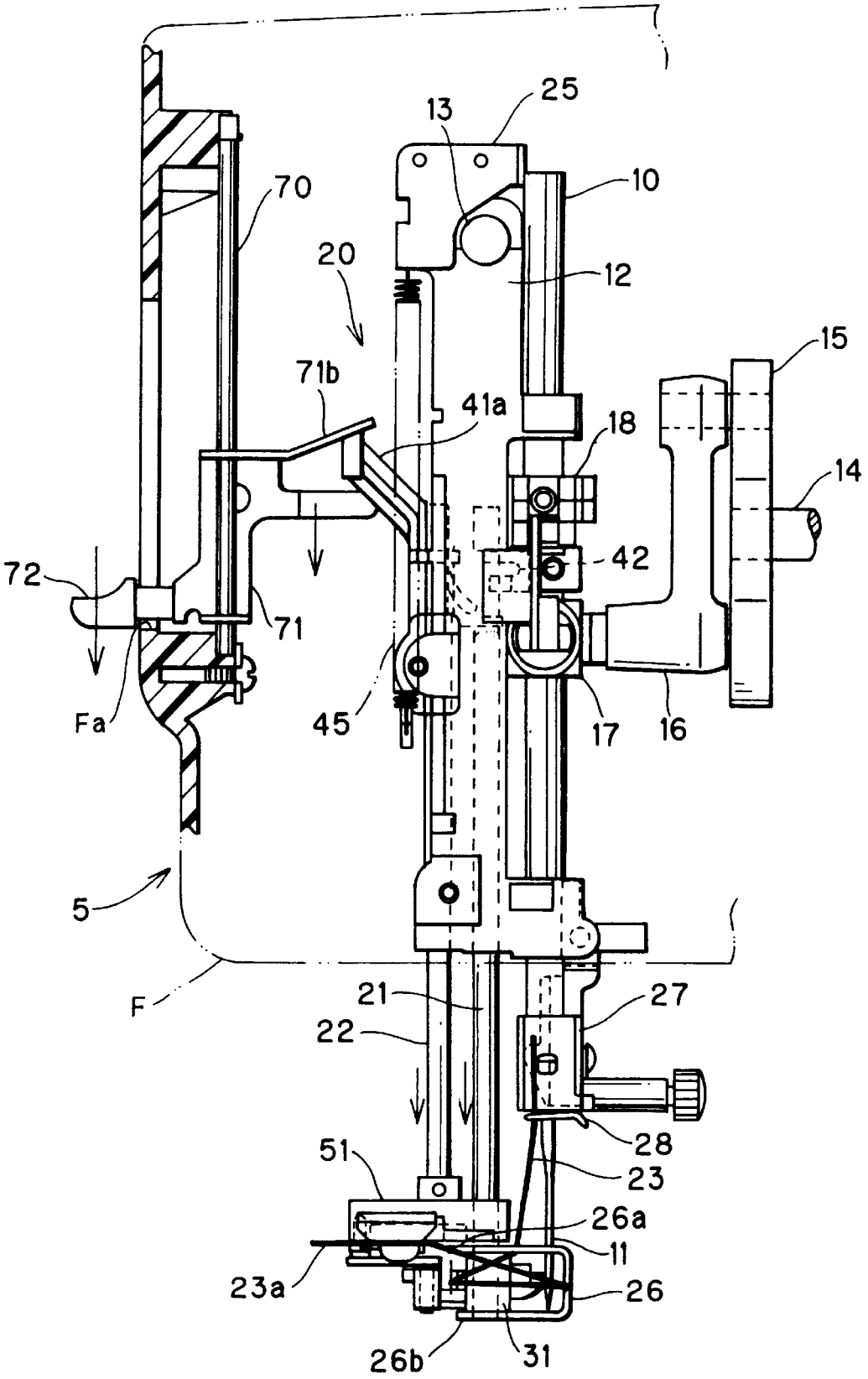
FIG. 8 is a front view showing the needle threading device during threading operations.
Figure 9:
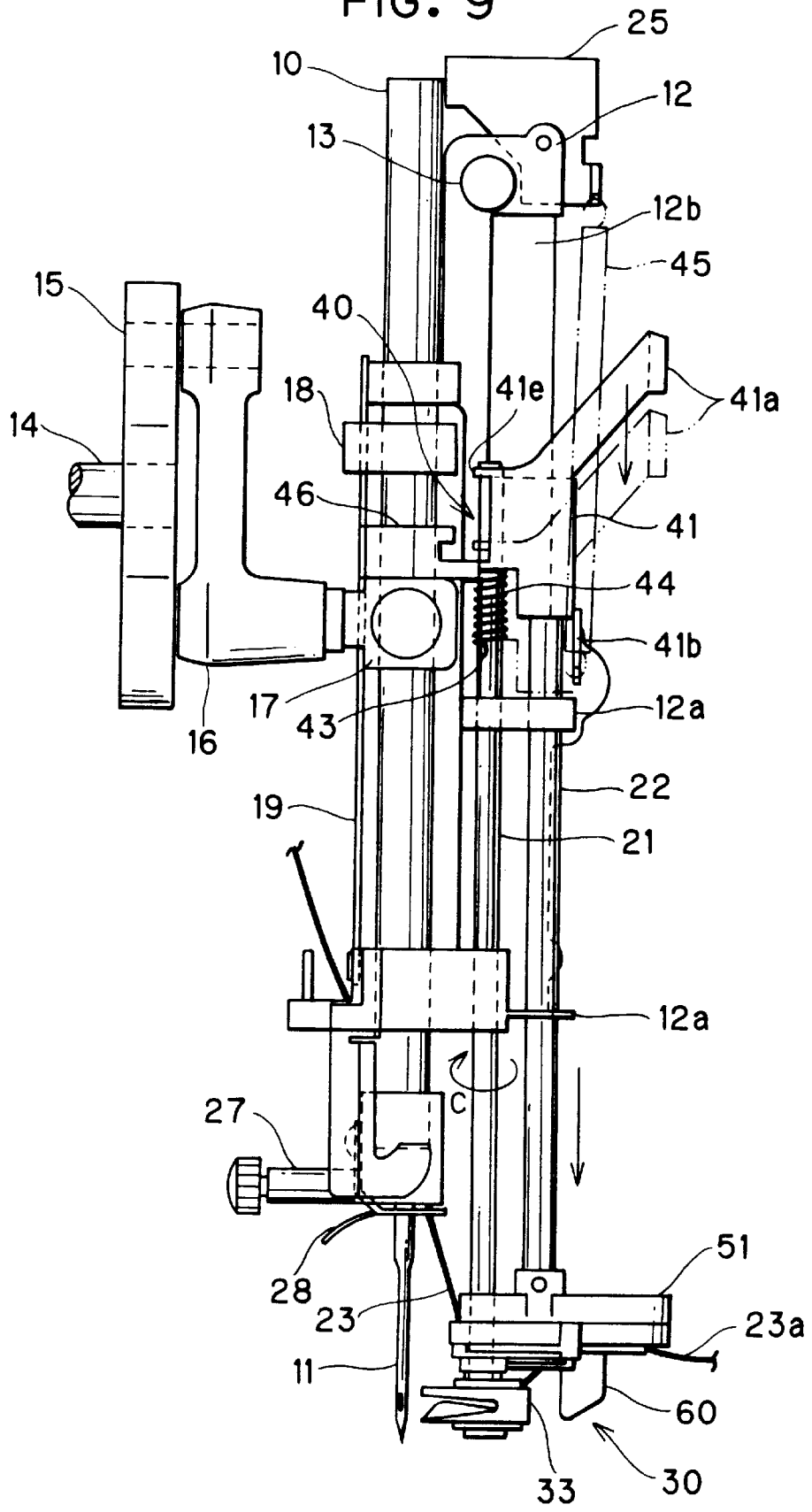
FIG. 9 is a rear view showing the needle threading device during threading operations.
Figure 10:
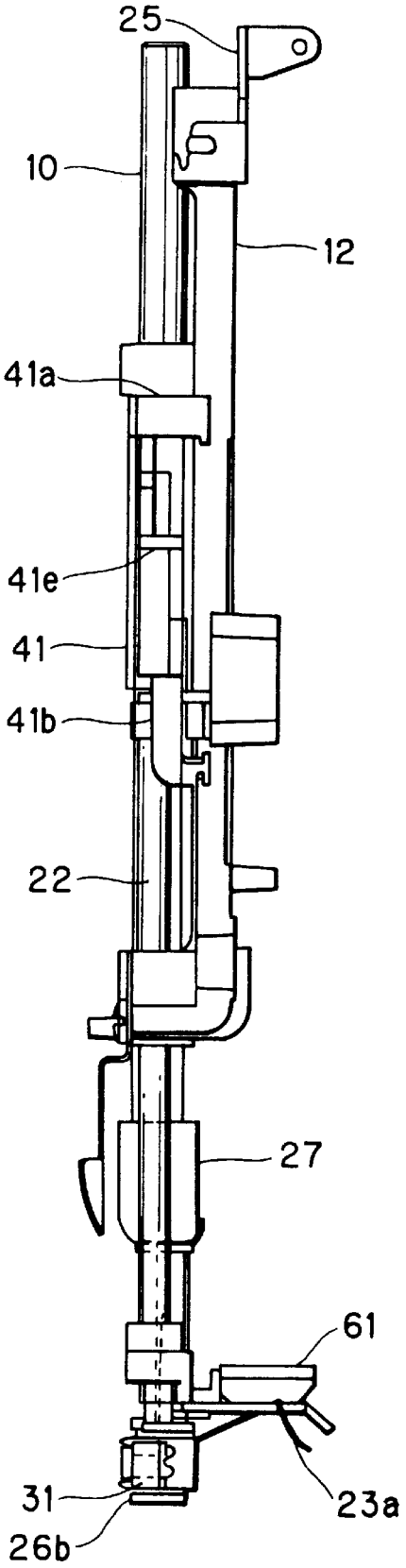
FIG. 10 is a left side view showing the needle threading device during threading operations.
Figure 13:
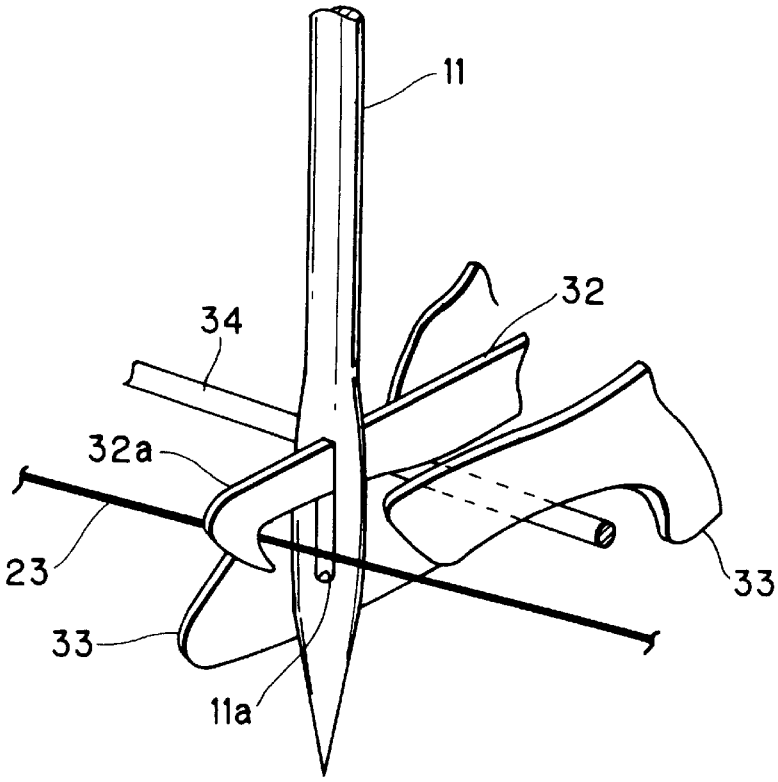
FIG. 13 is a perspective view showing a hook mechanism of the needle threading device during threading operations.

First, the configuration of the hook mechanism 30 will be described. As shown in FIG. 9, the hook mechanism 30 is fixed to the lower end of the needle threading shaft 21. As shown in FIGS. 7 and 13, the hook mechanism 30 includes a hook support member 31, a needle threading hook 32, a pair of guide members 33, and a thread supporting wire 34. The hook support member 31 is formed from a synthetic resin, and is fixed to the lower end of the needle threading shaft 21 at a position between the supporting portions 26*a*, 26*b* as shown in FIG. 8. As shown in FIG. 7, a forward protruding connection portion 31*a* is formed in the hook support member 31.

The guide members 33 are disposed at corresponding sides of the needle threading hook 32 for guiding the upper thread 23. The thread supporting wire 34 is formed from a resilient material, and extends horizontally between the needle threading hook 32 and the guide members 33. As shown in FIG. 13, a hook portion 32*a* for catching the upper thread 23 is formed in the tip end of the needle threading hook 32.

As shown in FIGS. 5 and 7, the first thread guide member 24 is fixed integrally to the hook support member 31. The first thread guide member 24 has a hook-like shape that is formed with a downward extending bent portion near its tip. The bent portion functions as the thread guide portion 24*a*. The thread guide portion 24*a* is positioned at a side of the needle threading shaft 21 opposite from the hook mechanism 30, and separated from the needle threading shaft 21 by a predetermined distance. In other words, the first thread guide member 24 and the hook mechanism 30 are provided integrally to the needle threading shaft 21 so as to maintain a predetermined positional relationship with each other.

Figure 6:
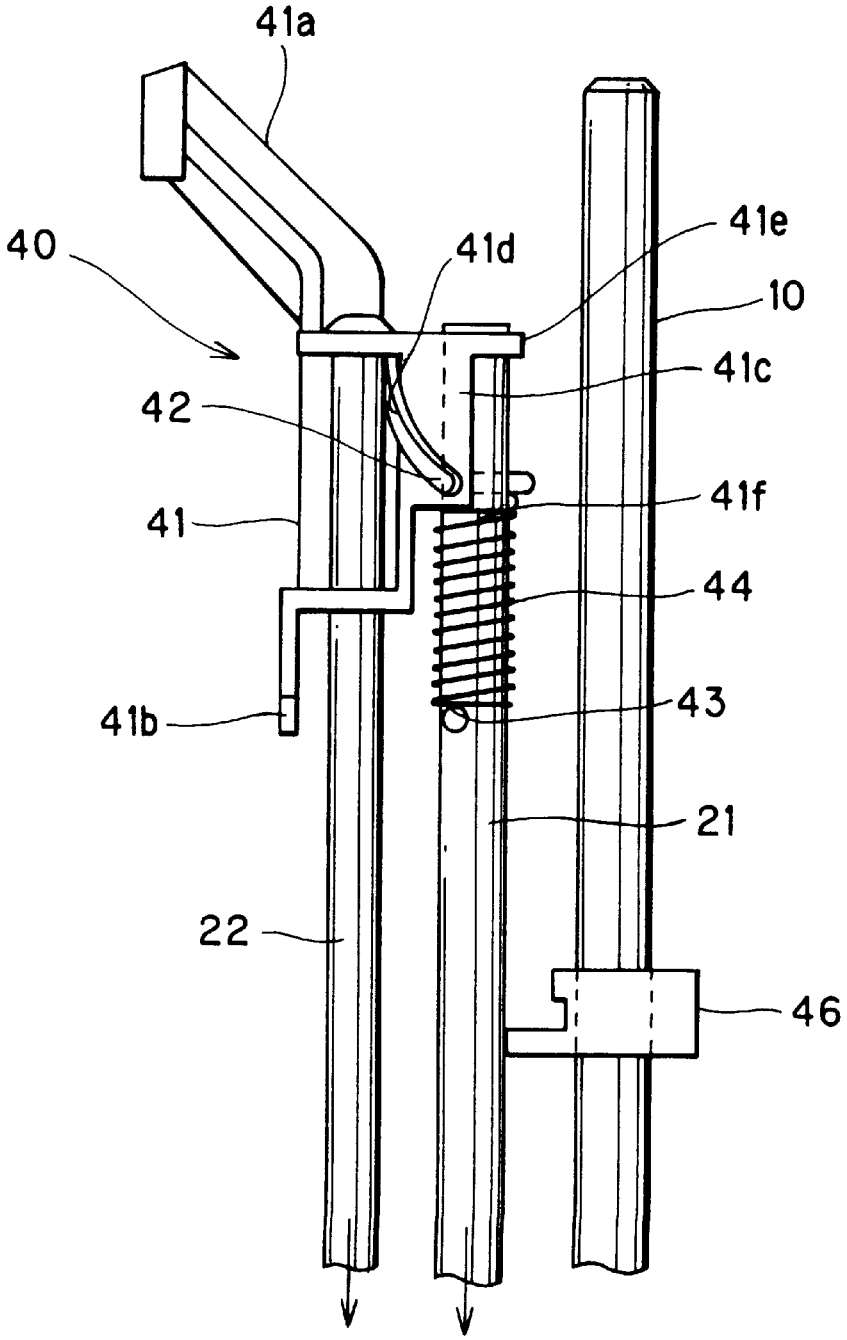
FIG. 6 is a front view showing a pivot mechanism of the needle threading device.

Next, the pivot mechanism 40 will be explained. The pivot mechanism 40 is for pivoting the needle threading shaft 21 by a predetermined angle. As shown FIGS. 4 and 6, and 9, the pivot mechanism 40 includes an operation body 41, a slide pin 42, a spring mounting pin 43, tension coil springs 44, 45, and a positioning member 46. The operation body 41 is formed from a synthetic resin material. The operation body 41 passes through the upper ends of the needle threading shaft 21 and the operation shaft 22 so as to be vertically movable. The operation body 41 is formed with an operation portion 41*a*, a spring support 41*b*, an external wall 41*c*, and an upper and lower pair of supporting portions 41*e*, 41*f*. The operation portion 41*a* extends in an upward slant. The external wall 41*c* covers about half of the outer periphery of upper end of the needle threading shaft 21. A spiral shaped pivot groove 41*d* is formed to the external wall 41*c*.

The slide pin 42 has a predetermined length, and passes through and is fixed to the needle threading shaft 21 at a position directly above the support portion 41*f*. One end of the slide pin 42 is engaged in the pivot groove 41*d*. The spring mounting pin 43 penetrates through and is fixed to the needle threading shaft 21 at a position below the slide pin 42 by a predetermined distance. The tension coil spring 44 is mounted around the needle threading shaft 21 at a position between the support portion 41*f* and the spring mounting pin 43. A spring support member 25 is attached to the needle bar stand 12. The tension coil spring 45 is stretched between the spring support portion 41*b* and the spring support member 25. The positioning member 46 is fixed to the needle bar 10 at a predetermined position.

As shown in FIG. 9, an indentation portion 12*b* is formed in the needle bar stand 12. Spring force of the tension coil spring 45 abuts the upper end of the operation body 41 against the upper end of the indentation portion 12*b*. As a result, as shown in FIG. 4, the needle threading shaft 21 and the operation shaft 22 are normally positioned in a predetermined retracted position.

On the other hand, when an operation grip 72 is moved downward as will be described later, the operation body 41, the needle threading shaft 21, and the operation shaft 22 are all moved down simultaneously against the spring force of the tension coil spring 45 until, as shown in FIG. 9, the slide pin 42 abuts against the positioning member 46, so that further lowering movement of the needle threading shaft 21 is prohibited. In other words, the positioning member 46 determines the lower most position of the needle threading shaft 21. When the needle threading shaft 21 is in its lower most position, the needle threading hook 32 fixed at the lower end of the needle threading shaft 21 is at a height level with the sewing needle eye 11*a* of the sewing needle 11.

Figure 11:
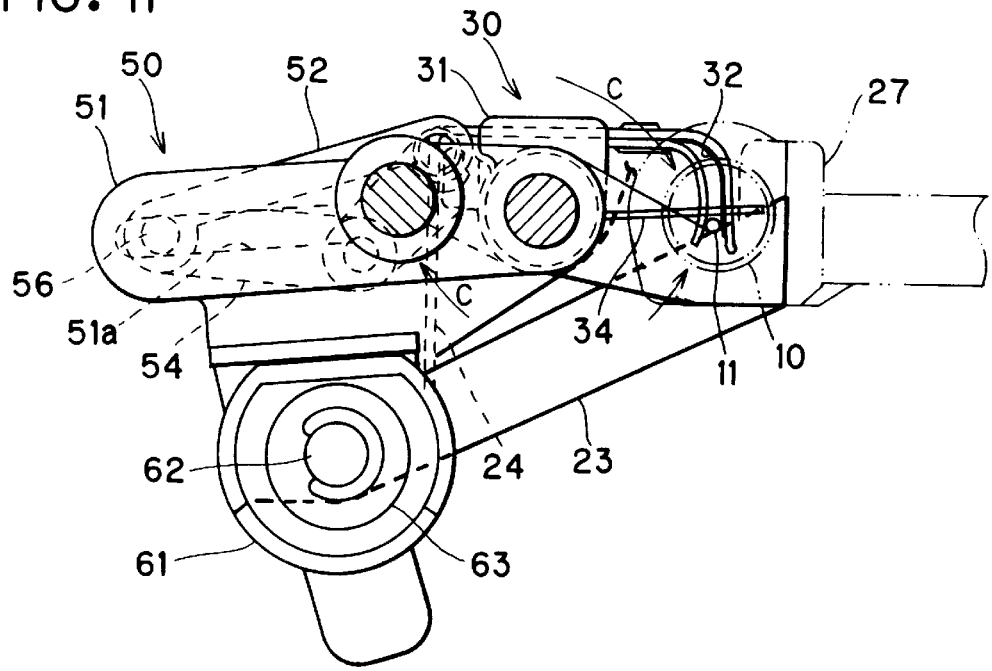
FIG. 11 is a cross-sectional view corresponding to FIG. 7 showing the needle threading device during threading operations.

Afterwards, when the operation body 41 is further moved downward as indicated by a two-dot chain line in FIG. 9, the slide pin 42 is guided by the pivot groove 41*d* so that the needle threading shaft 21 rotates in the clockwise direction C by a predetermined angle. At this time, as shown in FIG. 11, the hook mechanism 30 is also pivoted simultaneously toward the sewing needle 11. As a result, the needle threading hook 32 passes through the sewing needle eye 11*a*. At the same time, the first thread guide member 24 rotates in the clockwise direction C away from the sewing needle 11.

Next, an explanation for the link mechanism 50 will be provided. The link mechanism 50 is for rotating the second thread guide member 26 away from the first thread guide member 24 when the sewing needle 11 is threaded.

As shown in FIG. 7, the link mechanism 50 includes a link guide member 51, a first link plate 52, a pin 53, a second link plate 54, a pin 55, and a slide pin 56. The link guide member 51 extends leftward and rightward in a linear manner. The center portion of the link guide member 51 is fixed to the lower end of the first link plate 52. The right end of the link guide member 51 is rotatably supported on the needle threading shaft 21 at a position directly above the hook support member 31.

A linear shaped slide groove 51*a* is formed at the lower surface of the link guide member 51. Also, a forward extending connection wall 51*b* is integrally formed with the frond end of the link guide member 51. The right end of the first link plate 52 is freely rotatably connected to the support portion 26*a* of the second thread guide member 26 by the pin 53. The front end of the second link plate 54 is freely rotatably connected by the pin 55 to the connection portion 31*a* of the hook support member 31. The slide pin 56 connects the left end of the first link plate 52 and the rear end of the second link plate 54 so that the two are freely rotatable. Also, the upper end of the slide pin 56 is engaged in the slide groove 51*a* so as to be capable of moving along the slide groove 51*a*.

Figure 12:
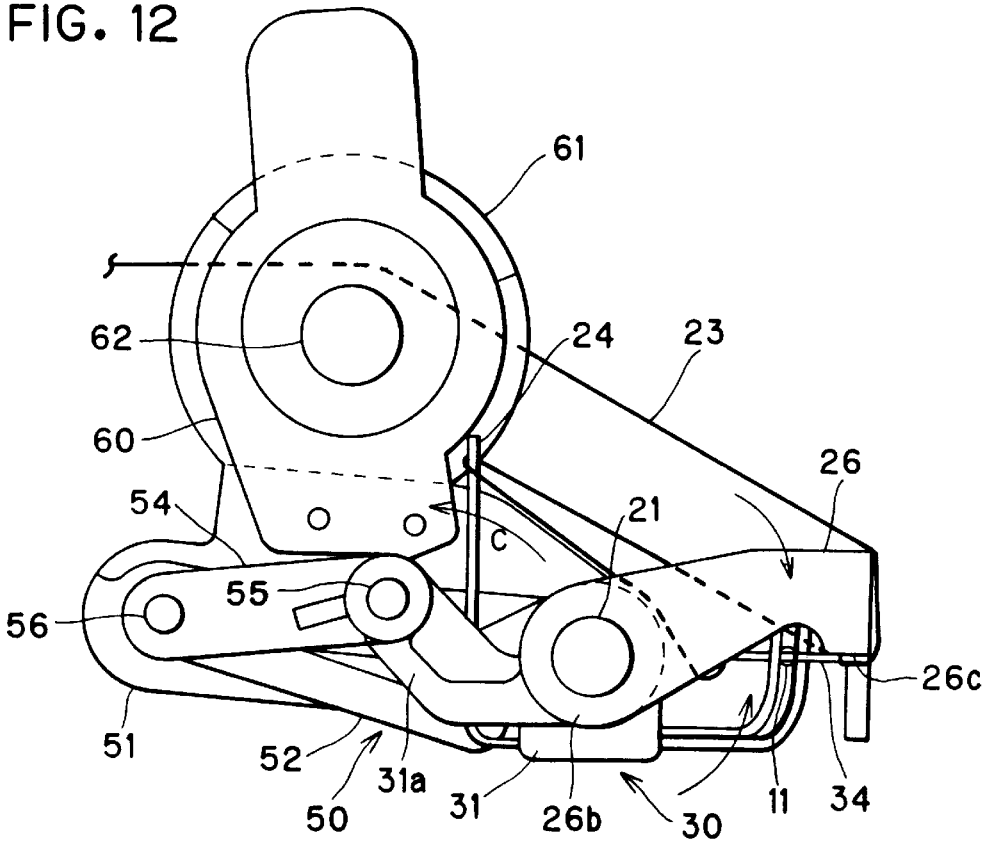
FIG. 12 is a plan view of the needle threading device viewed from below during threading operations.

As shown in FIG. 7, when the needle threading shaft 21 is in its waiting condition before rotating to thread the sewing needle 11, the second thread guide member 26 is oriented to protrude forward. Also, the thread guide portion 24*a* of the first thread guide member 24 is positioned within the inner space S (FIG. 5) defined directly interior to the thread guide portion 26*d* of the second thread guide member 26. When the needle threading shaft 21 rotates at its lower most position, as shown in FIGS. 11 and 12, the hook mechanism 30 and the first thread guide member 24 pivot interlockingly with each other in the clockwise direction C. Simultaneously with this, the second thread guide member 26 is pivoted in the counter clockwise direction by the link mechanism 50. That is to say, the second thread guide member 26 moves away from the first thread guide member 24 to approach the hook mechanism 30. As a result, the first thread guide member 24 positions at a substantially opposite side of the sewing needle 11 from the second thread guide member 26.

As shown in FIG. 12, the link mechanism 50 further includes a support plate 60, a support member 61 that serves as a pressing disk, a support pin 62, and a washer 63. The rear end of the support plate 60 is fixed to the lower surface of the connection wall 51*b*. The lower end of the upwardly protruding support pin 62 is fixed to the support plate 60. The support member 61 is supported by the support pin 62 so as to be vertically movable. The washer 63 prevents the support pin 62 from falling off the support pin 62. Although not shown in the drawings, a compression coil spring is mounted around the support pin 62 at a position between the washer 63 and the support member 61. This compression coil spring resiliently urges the support member 61 to press against the support plate 60 so that the support member 61 resiliently holds the free end portion 23*a* of the upper thread 23 against the support plate 60 with a slight pressure.

That is, when the sewing needle 11 is to be threaded, the upper thread 23 is fed out from an upper thread spool (not shown) to between the link guide member 51 and the support plate 60 following a thread pathway by way of a thread tension unit (now shown), the thread takeup lever 9, the thread guide 28, the first thread guide member 24, and the second thread guide member 26. The upper thread 23 is cut by a blade (not shown), and the free end portion 23*a* of the upper thread 23 is supported by a slight pressure by the support member 61. It should be noted that the blade is placed at a position separated from the support member 61 by a predetermined distance so that the free end portion 23*a* extends from the support member 61 by the predetermined amount which is required for threading the sewing needle 11 as described later.

As shown in FIG. 3, the frame F of the head portion 5 houses a support shaft 70, a movement member 71, and operation grip 72. The support shaft 70 extends vertically and is fixed to the frame F at both upper and lower ends. The movement member 71 is supported on the support shaft 70 so as to be vertically movable. A leftward protruding protrusion portion 71*a* and a rightward protruding connection member 71*b* are formed in the movement member 71. The operation grip 72 is mounted on the protrusion portion 71*a*. A slit FA is formed in the frame F so as to extend vertically. The operation grip 72 is vertically movable within the slit FA. The connection member 71*b* is capable of abutting the operation portion 41*a* of the operation body 41 from the above.

With this configuration, when the operation body 41 is raised upward, abutment of the operation portion 41*a* against the movement member 71 raises the operation grip 72 upward. As a result, when the operation body 41 is in its retracted position, the operation grip 72 will be in its upper most position. In other words, when the operation grip 72 is pressed downward, the operation body 41 is lowered into its lower most position and rotated via the movement member 71 so that the sewing needle 11 is threaded.

Next, an explanation will be provided for needle threading operation by the needle threading unit 20. First, when the needle bar 10 is in the retracted position, the upper thread 23 is fed out from the spool and suspended along the thread pathway from the thread guide 28, the first thread guide member 24, the second thread guide member 26, and to the support member 61 in this order. The upper thread 23 is then cut by the blade and the free end portion 23*a* of the upper thread 23 is supported by a slight pressure by the support member 61.

It should be noted that at this time the thread guide portion 24*a* of the first thread guide member 24 is positioned within the inner space S defined directly interior to the thread guide portion 26*d* of the second thread guide member 26. Therefore, the upper thread 23 can be caught on the thread guide portion 24*a* merely by hanging the upper thread 23 on the thread guide portion 26*d*. In this way, operations for suspending the upper thread 23 can be simplified.

Also, the free end portion 23*a* of the upper thread 23 extends from the support member 61 by the predetermined amount as describe above.

Next, as shown in FIG. 8, the operation grip 72 is manually moved downward, so that the needle threading shaft 21 and the operation shaft 22 are simultaneously moved down to the lower most position via the movement member 71 and the operation body 41. At this time, the upper thread 23 is fed from the free end portion 23*a* by the amount required for the second needle guide member 26 to move down to the lower most position. Also, the upper thread 23 is reliably engaged by both thread guide portions 24*a*, 26*d*.

Next, the operation grip 72 is lowered further so that the needle threading shaft 21 rotates in the clockwise direction C by a predetermined angle. Simultaneously, the hook mechanism 30 and the first thread guide member 24 pivot in the clockwise direction C, and the second thread guide member 26 rotates in the counter clockwise direction, from the orientation shown in FIG. 7 to that shown in FIG. 11. That is to say, the hook mechanism 30 approaches the sewing needle 11, whereupon the needle threading hook 32 passes through the sewing needle eye 11*a* of the sewing needle 11. The first thread guide member 24 moves away from the sewing needle 11. The second thread guide member 26 moves away from the first thread guide member 24 and approaches the hook mechanism 30 and the sewing needle 11.

As a result, the second needle guide member 26 feeds the upper thread 23 from the free end portion 23*a* by the amount required for the needle threading hook 32 to thread the sewing needle 11. Also, as shown in FIGS. 8, 11, and 12, the upper thread 23 is suspended on both the thread guide portions 24*a*, 26*d* in a zigzag manner as viewed in plan. At this time, as shown in FIG. 13, the portion of the upper thread 23 suspended between the thread guide portions 24*a*, 26*d* is positioned directly in front of needle threading hook 32 with sufficient amount of tension, and guided by the guide members 33 to a predetermined position where it can engage the needle threading hook 32.

Figure 14:
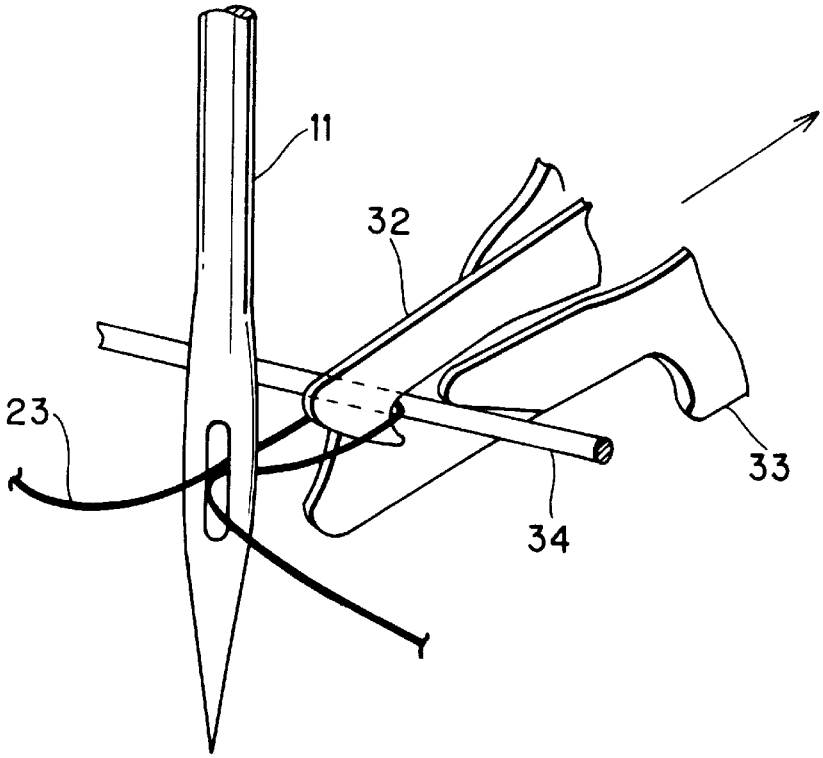
FIG. 14 is a perspective view showing a needle threaded by the hook mechanism.
Figure 15:
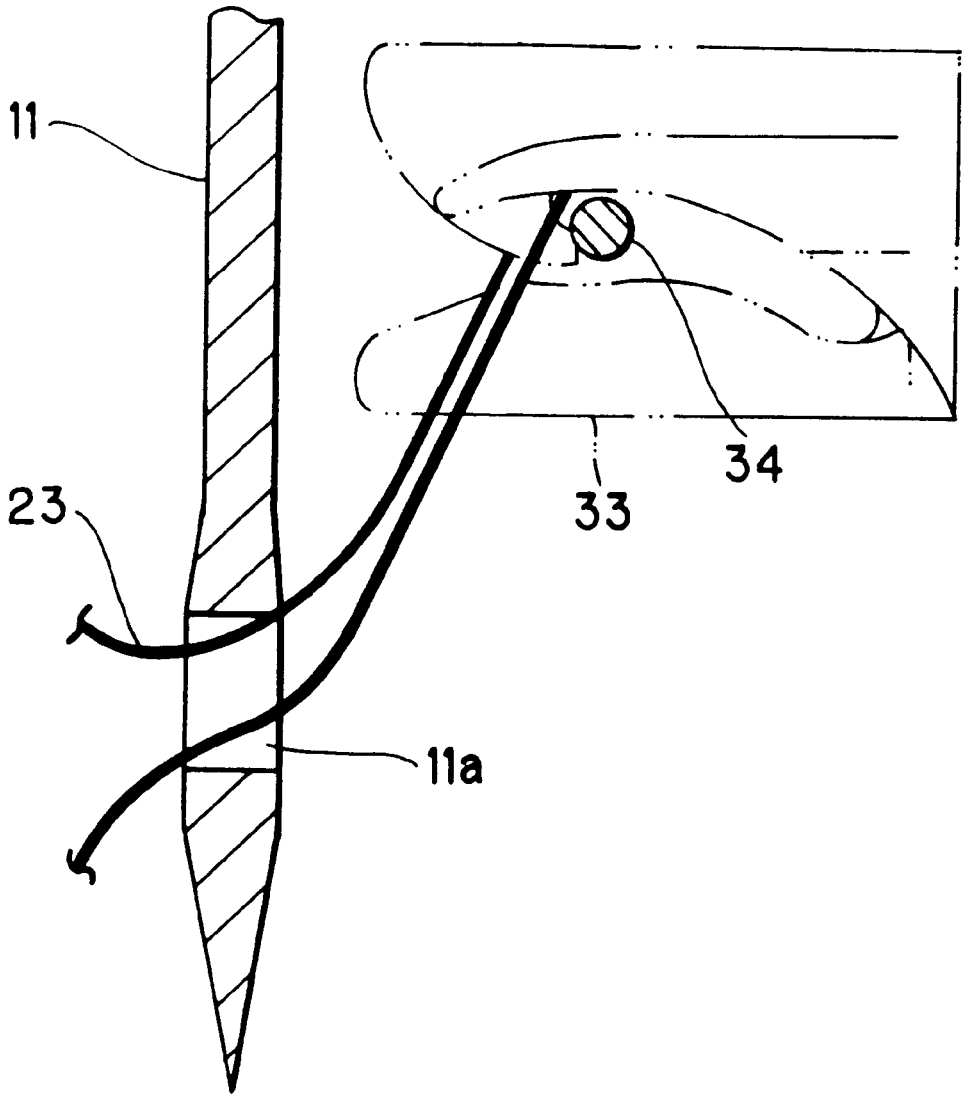
FIG. 15 is a cross-sectional view showing the hook mechanism lifted after threading the needle.

Afterwards, the downward pressing force on the operation grip 72 is released, so that the spring force of the tension coil spring 45 raises the operation body 41 upward. In association with this, the first and second thread guide members 24, 26 and the hook mechanism 30 return to the original positions. As a result, as shown in FIGS. 14 and 15, the needle threading hook 32 pulls the upper thread 23 through the sewing needle eye 11*a,* so that the sewing needle 11 is threaded. Then, the upper thread 23 is supported by the thread supporting wire 34 so that the upper thread 23 will not separate from the needle threading hook 32. Afterwards, in association with upper movement of the needle threading shaft 21, the upper thread 23 separates from the needle threading hook 32.

Further, the sewing needle 11 can be reliably threaded regardless of the width of the upper thread 23.

As described above, according to the present embodiment, when the first thread guide member 24, the hook mechanism 30, and the second needle guide member 26 pivot for catching the upper thread 23 in the zigzag manner, the upper thread 23 can be automatically fed out from the free end portion 23*a* in a simple manner by the amount required for the needle threading hook 32 to thread the sewing needle 11.

Also, because the thread guide portion 24*a* of the first thread guide member 24 is normally positioned within the inner space S defined by the second needle guide member 26, the upper thread 23 caught on the second needle guide member 26 is automatically caught on the first thread guide member 24.

Also, the support member 61 is provided to a position substantially level with the lower end of the needle threading shaft 21. Therefore, the free end portion 23*a* of the upper thread 23 can be held by the support member 61 with a slight pressure. Also, the upper thread 23 can be easily fed from the free end portion 23*a* when the second needle guide member 26 pivots toward the hook mechanism 30.

While the invention has been described in detail with reference to specific embodiments thereof, it would be apparent to those skilled in the art that various changes and modifications may be made therein without departing from the spirit of the invention, the scope of which is defined by the attached claims.

For example, the operation shaft 22 can be replaced by a moving body to be guided by the needle threading shaft 21 so as to reduce the cost. Also, the needle threading unit 20 can be separated from a needle bar vertically moving mechanism and provided to the frame F of the head portion 5. Furthermore, the needle threading device according to the present invention can be applied to a variety of different sewing machines, such as, household sewing machines or industrial sewing machines.

What is claimed is:

1. A needle threading device used in a sewing machine comprising a needle bar extending in a vertical direction and supporting a sewing needle formed with an eye, the needle threading device comprising;

a hook mechanism that is pivotable from an initial position to a pivoted position by a predetermined angle, the hook mechanism comprising a hook, wherein when the hook mechanism pivots to the pivoted position, the hook penetrates through the eye of the sewing needle;

a first thread guide that is provided at a position separated from the hook mechanism by a predetermined distance; and a second thread guide that is provided at a position close to the first thread guide, wherein when the hook mechanism pivots to the pivoted position, the second thread guide pivots relative to the first thread guide so as to locate at a substantially opposite side of the sewing needle from the first thread guide.

2. The needle threading device according to claim 1, wherein the first thread guide is formed with a thread guide portion, the second thread guide is formed with a thread guide portion and defines an inner space, and when the hook mechanism is at the initial position, the thread guide portion of the first thread guide positions within the inner space near the thread guide portion of the second thread guide, and wherein when an upper thread is hooked onto the thread guide portion of the second thread guide while the hook mechanism is at the initial position, the upper thread is simultaneously and automatically hooked onto the thread guide portion of the first thread guide.

3. The needle threading device according to claim 2, wherein the first thread guide has a hook shape that is formed with a downward extending bent portion near its tip, and the second thread guide has a C shape as viewed from a side.

4. The needle threading device according to claim 1, further comprising a guide member that is attached to an lower end of the needle bar, wherein the guide member, the first thread guide, and the second thread guide define a thread pathway along which the upper thread is guided.

5. The needle threading device according to claim 1, wherein when the hook mechanism is pivoted to the pivoted position, the first thread guide and the second thread guide feed an upper thread by an amount required for threading the sewing needle.

6. The needle threading device according to claim 1, further comprising a thread holder that holds a free end portion of an upper thread leading from the second thread guide with a slight pressure.

7. The needle threading device according to claim 6, wherein when the hook mechanism pivots to the pivoted position, the first thread guide and the second thread guide feed the upper thread from the free end portion by an amount required for threading the sewing needle.

8. The needle threading device according to claim 1, wherein when the hook mechanism pivots to the pivoted position, the first thread guide pivots together with the hook mechanism in a first pivot direction, and the second thread guide pivots in a second pivot direction opposite to the first pivot direction.

9. A needle threading device used in a sewing machine comprising a needle bar stand and a needle bar supported by the needle bar stand, the needle bar extending in a vertical direction and supporting a sewing needle formed with an eye, the needle threading device comprising;

a threading shaft that extends in the vertical direction, the threading shaft being supported by the needle bar stand at a position close to the needle bar so as to be rotatable and movable in the vertical direction, the threading shaft having a lower end;

a hook mechanism that is attached to the lower end of the threading shaft, the hook mechanism comprising a hook;

a pivot mechanism that lowers the threading shaft from a predetermined upper position to a predetermined lower position and rotates the threading shaft in a rotational direction by a predetermined angle at the predetermined lower position, wherein when the pivot mechanism rotates the threading shaft at the predetermined lower position, the hook mechanism is pivoted in the rotational direction together with the threading shaft, and the hook penetrates through the eye of the sewing needle;

a first thread guide that is fixed at the lower end of the threading shaft at a position separated from the hook mechanism by a predetermined distance;

a second thread guide that is pivotably supported by the lower end of the threading shaft, wherein when the threading shaft is at the predetermined upper position, the second thread guide is at a position close to the first thread guide; and a link mechanism that links the first thread guide and the second thread guide such that when the pivot mechanism rotates the threading shaft in the rotational direction, the second thread guide pivots relative to the first thread guide so as to locate at a substantially opposite side of the sewing needle from the first thread guide.

10. The needle threading device according to claim 9, wherein the first thread guide is formed with a thread guide portion, the second thread guide is formed with a thread guide portion and defines an inner space, and when the threading shaft is at the predetermined upper position, the thread guide portion of the first thread guide positions within the inner space near the thread guide portion of the second thread guide, and wherein when an upper thread is hooked onto the thread guide portion of the second thread guide while the threading shaft is at the predetermined upper position, the upper thread is simultaneously and automatically hooked onto the thread guide portion of the first thread guide.

11. The needle threading device according to claim 10, wherein the first thread guide has a hook shape that is formed with a downward extending bent portion near its tip, and the second thread guide has a C shape as viewed from a side.

12. The needle threading device according to claim 9, further comprising a guide member that is attached to an lower end of the needle bar, wherein the guide member, the first thread guide, and the second thread guide define a thread pathway along which the upper thread is guided.

13. The needle threading device according to claim 9, wherein when the threading shaft is rotated in the rotational direction by the predetermined angle, the first thread guide and the second thread guide feed an upper thread by an amount required for threading the sewing needle.

14. The needle threading device according to claim 9, further comprising a thread holder that holds a free end portion of the upper thread leading from the second thread guide with a slight pressure, the thread holder being provided at a position level with the lower end of the threading shaft at the predetermined upper position.

15. The needle threading device according to claim 14, wherein when the threading shaft is rotated in the rotational direction by the predetermined angle, the first thread guide and the second thread guide feed the upper thread from the free end portion by an amount required for threading the sewing needle.

16. The needle threading device according to claim 9, wherein when the threading shaft is rotated in the rotational direction, the first thread guide pivots in the rotational direction together with the threading shaft, and the second thread guide pivots in a direction opposite to the rotational direction by the link mechanism.

* * * * *